United States Patent [19]

Matsuzawa et al.

[11] Patent Number: 4,867,858

[45] Date of Patent: Sep. 19, 1989

[54] INSOLUBLE ANODE MADE OF LEAD ALLOY

[75] Inventors: Hirokage Matsuzawa, Kamagaya; Ikuo Suzuki, Narita; Teruhisa Tsuruga; Takashi Orihashi, both of Matsudo; Katsushi Imanishi, Ibaragi; Tadashi Takemura, Matsudo, all of Japan

[73] Assignee: Yoshizawa LA Kabushiki Kaisha, Tiba, Japan

[21] Appl. No.: 168,925

[22] Filed: Mar. 16, 1988

[51] Int. Cl.[4] ..... C25B 11/00

[52] U.S. Cl. ..... 204/290 R; 204/290 F; 204/293; 420/563; 420/570

[58] Field of Search ..... 204/290 R, 290 F, 293; 420/563

[56] References Cited

U.S. PATENT DOCUMENTS 4,107,407 8/1978 Koch ..... 429/225

FOREIGN PATENT DOCUMENTS 0132029 1/1985 European Pat. Off. ..... 204/290 R 0126935 8/1982 Japan ..... 420/570

*Primary Examiner*—John F. Niebling

*Assistant Examiner*—Kathryn Gorgos

*Attorney, Agent, or Firm*—Price, Heneveld, Cooper, DeWitt & Litton

[57] ABSTRACT

The corrosion resistance of an insoluble anode for use under high current condition, which anode may be made from iron or copper for example, is improved by coating the anode with an alloy of lead, tin and indium.

10 Claims, 1 Drawing Sheet

INSOLUBLE ANODE MADE OF LEAD ALLOY

FIELD OF THE INVENTION

The present invention relates to an insoluble anode made of lead alloy and, more particularly, to an insoluble anode made of Pb-In-S alloy exhibiting a high corrosion resistance in sulfuric bath.

BACKGROUND OF THE INVENTION

Electroplating techniques are essential in industry for providing corrosion resistance and other various purposes It has been common practice to electroplate the object such as a strip of steel or copper sheet with Zn, Sn, Ni, Cu, Fe or the other metals or alloys thereof. Among these, zinc electroplating of steel is becoming more widely used, particularly because of the increased demand for improved corrosion resistance in the automotive and household electric appliance fields, etc.

Particularly in zinc electroplating of the car body, an electroplating operation using a high current density has recently been adopted to achieve so-called thick zinc plating with an increased amount of zinc deposited. For such zinc electroplating, a soluble anode has usually been used. However, because the soluble anode must be modified for use under high current density conditions and other problems attributable to use of a soluble anode, for example, complicated control and maintenance of the plating bath due to increased electrode pitch must also be solved. There has been a steady push to develop insoluble anodes as replacements for soluble anodes, especially in high current density processes.

The insoluble anode has also found its application in electrolytic formation of metallic, particularly, copper foil. In such electrolytic copper foil formation of the prior art, the insoluble anode is typically disposed so as to be opposed to and spaced by a predetermined distance from a drum made, for example, of titanium along a peripheral segment defined by 3 to 6 o'clock position and 6 to 9 o'clock position A solution of copper sulfate is circulated through a gap defined between the drum serving as the cathode and the insoluble anode to achieve electrode position of copper on the peripheral segment of the drum. The copper foil thus formed by the continuous electrode position of copper on said drum is peeled off. In view of the fact that the electronics industry requires a large quantity of copper foil, operation using a current density higher than that which has been conventionally used is now under review with respect to improving productivity.

As will be appreciated, the insoluble anode occupies an important position in electrolytic processes such as plating and foil formation.

Most of the well-known insoluble anodes are those made of lead, since lead is corrosion-resistant to plating bath or foil formation electrolytic bath conditions, and there is produced, as a result of plating energization, lead dioxide on the surface of the anode, which functions as an effective discharge surface.

However, such an insoluble anode of the prior art has proved to have a serious drawback in that said lead dioxide produced during the process of plating is easily separated from the lead surface due to its internal strain.

Now the prior art will be discussed, particularly with respect to the electroplating. As a countermeasure to avoid the separation of lead dioxide from the lead surface, use of a lead alloy containing therein various alloy elements has been proposed. Among various types of such a lead alloy systems, a Pb-In alloy system has been considered as a typical one of the potentially useful lead alloy systems. For example, Japanese Provisional Publication No. 59-28598 discloses Pb-0.5 to 10% In or Pb-0.5 to 10% Ag. However, the Pb-In alloy system exhibits unsatisfactory corrosion-resistance and, accordingly, this prior art proposes addition of Ag in order to improve the corrosion-resistance.

Nevertheless, Ag is not necessarily preferable as the element added to the insoluble anode and its effect to improve the corrosion-resistance of this anode is not adequate, because:

(A) Ag is one of the expensive precious metals, and (B) Ag has a melting point higher than that of Pb.

Furthermore, such a lead alloy, even with Ag added, cannot exhibit the desired corrosion-resistance, particularly under a high current density condition.

As has been mentioned at the beginning, this field of industry recently has developed a tendency to adopt the operation performed under a high current density condition rather than one under a low current density condition in various electrolytic operations such as electroplating and electrolytic foil formation. Accordingly, there is a serious demand for development of a low melting point anode exhibiting excellent corrosion-resistance and facilitating fabrication as well as working not only under said low current density condition but also under said high current density condition.

SUMMARY OF THE INVENTION

In view of such situation, a principal object of the present invention is to develop an improved insoluble anode made of lead alloy exhibiting a high corrosion-resistance even under a high current density condition and containing neither expensive precious metals nor elements having their respective melting points higher than that of lead.

Zealous effort of the inventors directed to the object as set forth above has revealed the fact that use of In with Sn is very advantageous to achieving said objective. In has a melting point of 156° C. and Sn has a melting point of 232° C., both being lower than the 327° C. melting point of Pb. It is a surprising, significant discovery that these two additive elements having such low melting points may be exclusively used to obtain a desired anode exhibiting an excellent corrosion-resistance even under the high current density condition. Experiments have revealed that a combination of In (0.01 to 5% by weight) with Sn (0.01 to 5% by weight) is effective.

Based on this knowledge, the present invention provides an insoluble anode including a discharging surface made of lead alloy containing In of 0.01 to 5% by weight, Sn of 0.01 to 5% by weight, and the rest consisting of lead and inevitable impurities.

The expression "high current density" as used herein should be understood to cover the order of current density that is 100A/dm$^2$ or higher, normally 160A/dm$^2$ or higher, and most preferably 200A/dm$^2$. In connection with the formation of foil, this expression should be understood to cover the current density of 50A/dm$^2$ or higher The anode constructed in accordance with the present invention exhibits a high corrosion resistance even under a high current density condition and serves as a functional type of electrode adapted for the high current recently used more often, with an advantageous result in various applications such as metallic electroplating, electrolytic formation of metallic foil and electrolytic refining. The anode of the present invention is useful particularly for thick zinc electroplating and electrolytic formation of copper foil. Use of the electrode constructed according to the present invention makes it possible to improve productivity such as by acceleration of production line speed and speed-up of plating film or formation of metallic foil. At the same time, it provides various advantages, as for example, an effective reduction of potential corrosion prolongs the useful life of the electrode and facilitates control and maintenance of the plating bath.

DESCRIPTION OF THE PREFERRED EMBODIMENT

Figure 1:
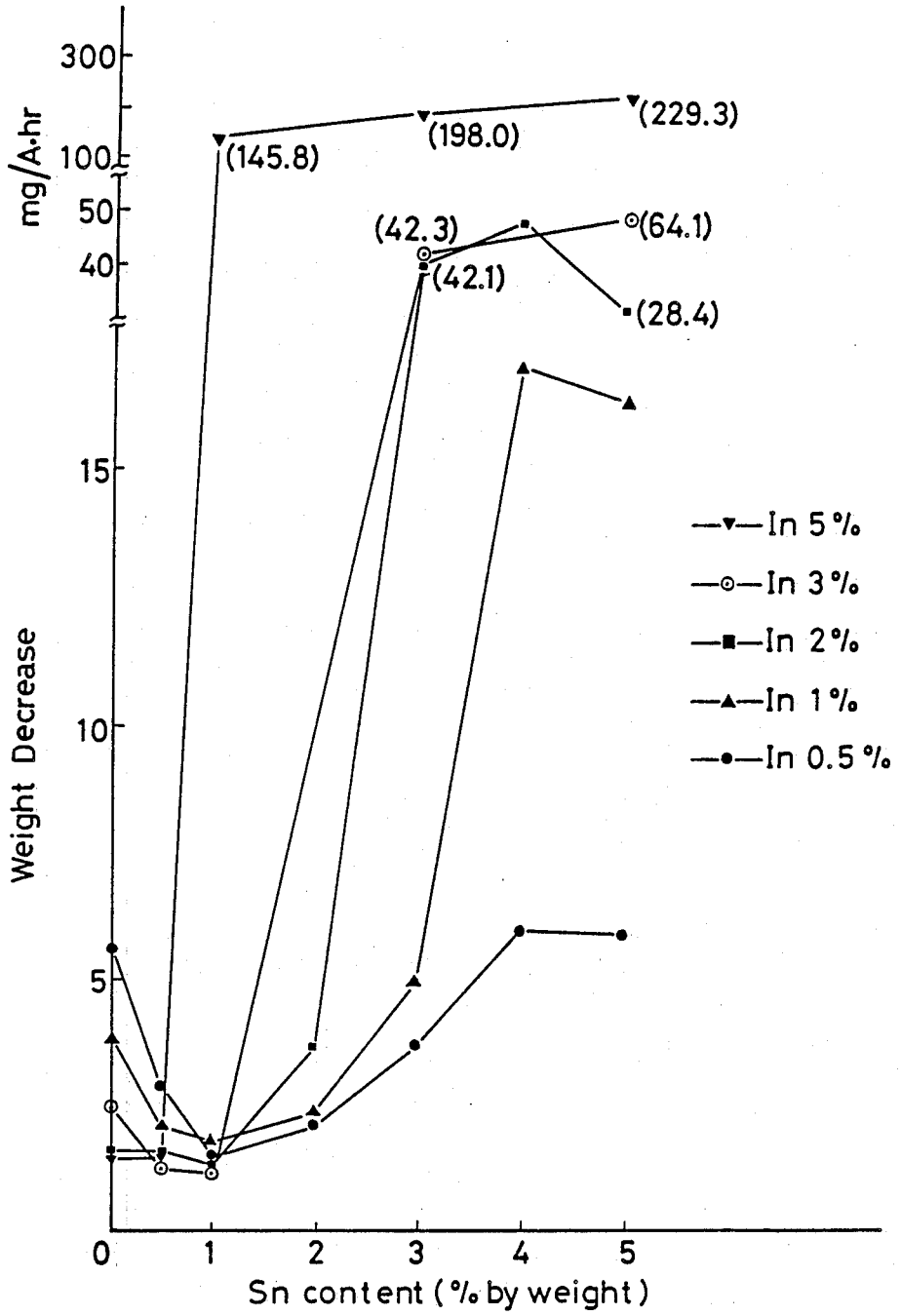
FIG. 1 graphically illustrates a relationship between the In content (% by weight) and the weight decrease (mg/A hr) with respect to several levels of Sn content.

According to the present invention, In in the amount of 0.01 to 5%, preferably 0.5 to 4% by weight and Sn weight, are added to Pb. Addition of In to Pb results in improvement of the corrosion-resistance and the addition of Sn to the Pb-In alloy containing In at any one of the selective ratios within the range as defined above, results in a remarkable improvement of the corrosion-resistance within the specified quantity range of the Sn addition. Accordingly, the optimum quantity of Sn addition is selected in accordance with the particular quantitative level of In addition. As will be described more in detail with respect to the Example, a corrosion-resistance improving effect, for example as shown below, is obtained (pure Pb exhibited a weight decrease of 8.5 mg/A hr):

| In(%) | Sn(%) | weight decrease(mg/a hr) |
|---|---|---|
| 0.5 | 1 to 2 | 1.5 to 2.1 |
| 1 | 0.5 to 2 | 1.8 to 2.4 |
| 2 | 0.5 to 1 | 1.3 to 1.6 |
| 3 | 0.5 to 1 | 1.3 |

The minimum level of In addition required to provide the expected effect is 0.01%. When added in combination with Sn, the effect of In is saturated when added in excess of 5%. Sn provides its expected effect at and above 0.01% in combination with In, but provides a reverse effect when added in excess of 5%.

As has previously been described, the Pb-In-Sn alloy composed in accordance with the present invention is characterized by:

(A) being able to exhibit an excellent corrosion resistance even under the high current density condition, as evidenced by an extremely small weight decrease of ⅛ to 1/9 relative to that of pure Pb; and (B) being a low melting point material obtained by the addition to Pb of In and Sn, both having melting points lower than that of Pb. An insoluble anode exclusively composed of these elements having low melting points, is significantly advantageous. For example, the process of alloying is facilitated. The base metal is protected, when the anode is made of a base metal coated with the alloy in question, and a potential oxidation loss is reduced during remelting after recovery. The working process such as rolling is facilitated; and (C) the anode contains none of the expensive precious metals that have conventionally been used.

The present invention covers the anode using melted lead alloy of a predetermined composition. The anode can be encasing by rolling lead onto the desired anode as a whole. The anode core formed from a base material, which core may be iron or copper, for example, is coated with a highly corrosion-resistant metal such as titanium, niobium, tantalum or comprised of a single piece of suitable corrosion-resistant material by coating said base material on one side or both sides with said lead alloy. Concerning the method of coating, the present invention includes a wide selection of methods. For example, the method by which said lead alloy is deposited directly onto the base material as by means of TIG (tungsten inert gas) technique and the method by which the base material is surface-treated as, for example, by soldering or electroplating, then said lead alloy is deposition-padded onto said treated surface.

It is essential that at least the discharging surface of the anode be made of the alloy composed in accordance with the present invention.

The insoluble anode is preferable to the soluble anode for the various electrolytic operations such as electroplating and foil formation, since the former has many advantages as set forth below.

(A) Functional advantages:

(1) adaptability for the high current density condition making it possible to improve production line speed (i.e., to shorten a production line) for plating or foil formation and thereby to speed up formation of plating film or foil, particularly in thick plating and electrolytic copper foil formation;

(2) suitability for simultaneous deposition alloy metal plating;

(3) ability to provide homogeneous and uniform plating film or foil; and (4) ability to reduce the rate of elution into the bath.

(B) Operational advantages:

(1) ability to maintain the electrode pitch substantially constant and thereby to facilitate the maintenance thereof; simplification of the bath composition control; and (3) reduction in quantity of additives such as sludge precipitator.

These advantages allow the plating product of improved quality to be obtained at a reasonably low cost. Such merits further increase as the corrosion-resistance of the insoluble anode increases.

EXAMPLE I

Molten lead alloy of the composition as shown in Table 1 was prepared by the conventional melting technique, then the molten lead alloy was cast and thereafter rolled into a sheet having a thickness of 3 mm. A test material of 3 mm thickness×10 mm width×150 mm was cut from said sheet as an anode. The electrolytic discharge area was 1.5cm$^2$. As a cathode, a pure lead sheet of 5 mm thickness×60 mm width×150 mm length was used. More specifically, a pair of such cathodes were opposed to each other with interposition of the anode therebetween. A corrosion-resistance test was conducted in the following manner: With the anode and the cathodes immersed in a solution (pH=1.1) of sulfuric acid, acidified mirabilite previously prepared by adding 71 g/l of $Na_2SO_4$ solution with sulfuric acid(1+1), a series of electrolytic tests were conducted under conditions of bath temperatures of 40° C. to 60°

C., impressed current of 3A, current density of 200A/dm$^2$, and duration of energization of 100 hrs. After each test, the anode was dried in a drying oven and the weight decrease of each tested anode was determined. Then, the weight decrease per unit ampere was calculated from the actual weight decrease of each tested anode. The result of the tests is summarized in Table 1. FIG. 1 is a graphic representation corresponding to 1.

TABLE 1

| Test No. | Composition (% by weight) In | Sn | Pb | Weight Decrease (mg/A hr) |
|---|---|---|---|---|
| 1 | — | — | Rest | 8.5 |
| 2 | — | 0.5 | Rest | 5.6 |
| 3 | — | 1 | Rest | 2.3 |
| 4 | — | 3 | Rest | 5.4 |
| 5 | — | 5 | Rest | 5.5 |
| 6 | 0.5 | — | Rest | 5.8 |
| 7 | 0.5 | 0.5 | Rest | 2.9 |
| 8 | 0.5 | 1 | Rest | 1.5 |
| 9 | 0.5 | 2 | Rest | 2.1 |
| 10 | 0.5 | 3 | Rest | 3.7 |
| 11 | 0.5 | 4 | Rest | 6.0 |
| 12 | 0.5 | 5 | Rest | 5.9 |
| 13 | 1 | — | Rest | 3.9 |
| 14 | 1 | 0.5 | Rest | 2.1 |
| 15 | 1 | 1 | Rest | 1.8 |
| 16 | 1 | 2 | Rest | 2.4 |
| 17 | 1 | 3 | Rest | 5.0 |
| 18 | 1 | 4 | Rest | 17.0 |
| 19 | 1 | 5 | Rest | 16.3 |
| 20 | 2 | — | Rest | 1.6 |
| 21 | 2 | 0.5 | Rest | 1.6 |
| 22 | 2 | 1 | Rest | 1.3 |
| 23 | 2 | 2 | Rest | 3.7 |
| 24 | 2 | 3 | Rest | 42.1 |
| 25 | 2 | 4 | Rest | 48.8 |
| 26 | 2 | 5 | Rest | 28.4 |
| 27 | 3 | — | Rest | 2.5 |
| 28 | 3 | 0.5 | Rest | 1.3 |
| 29 | 3 | 1 | Rest | 1.3 |
| 30 | 3 | 3 | Rest | 42.3 |
| 31 | 3 | 5 | Rest | 64.1 |
| 32 | 5 | — | Rest | 1.5 |
| 33 | 5 | 0.5 | Rest | 1.6 |
| 34 | 5 | 1 | Rest | 145.8 |
| 35 | 5 | 3 | Rest | 198.0 |
| 36 | 5 | 5 | Rest | 229.3 |

Provision of the insoluble anode made of an alloy having high corrosion-resistance and low melting point that is well adaptive to the high current density condition allows plating as well as production of high quality foil with high productivity by facilitating the bath control. Specifically, such effect is achieved by:

(1) reduced extent of potential corrosion and resultant prolongation of a useful life of the anode (leading to a corresponding cost reduction);

(2) reduced amount of potential corrosion resulting in reduction of days consumed by readjustment of the gap distance;

(3) reduced amount of potential corrosion resulting in simplified bath composition control;

(4) reduced quantity of additives required such as sludge precipitator (leading to a corresponding cost reduction);

(5) improved product quality;

(6) facilitation of alloying and a correspondingly reduced cost;

(7) base metal of the anode being free from any deformation during welding or padding thereto;

(8) reduced loss due to oxidation occurring during remelt after recovery;

(9) facilitation of working such as rolling, extrusion, severance or welding; and

(10) reduced amount of potential corrosion, resulting in the ability to provide a thin and light product.

We claim:

1. An insoluble anode including a discharging surface formed of an alloy consisting of 0.01 to 5% by weight of In, 0.01 to 5% by weight of Sn, the remainder being of lead and inevitable impurities.

2. An insoluble anode as recited in claim 1, wherein the entire anode consists of said lead alloy.

3. An insoluble anode as recited in claim 1, wherein said anode includes, as its base material, a core of material coated with a suitable corrosion-resisting substance, said base material being coated, at least on one side thereof, with said lead alloy.

4. An insoluble anode as recited in claim 1, wherein said anode includes a core made of a suitable corrosion-resisting substance coated on at least one side thereof with said lead alloy.

5. An insoluble anode as recited in claim 1 wherein the amount of tin is in the range from 0.5 to 2.0% by weight.

6. An insoluble anode as recited in claim 1 wherein the amount of indium is in the range from 0.5 to 4% by weight and the amount of tin is in the range from 0.5 to 2.0% by weight.

7. An insoluble anode as recited in claim 1 wherein the amount of indium is in the range from 0.5 to 3% by weight and the amount of tin is in the range from 0.5 to 2% by weight.

8. An insoluble anode as recited in claim 1 wherein the amount of indium is in the range from 2 to 3% by weight and the amount of tin is in the range from 0.5 to 1% by weight.

9. An insoluble anode as recited in claim 1 wherein the combined amount of indium and tin is in the range from 1.5 to 4% by weight.

10. An insoluble anode as recited in claim 1 wherein the combined amount of indium and tin is not greater than 3% by weight.

* * * * *

UNITED STATES PATENT AND TRADEMARK OFFICE

CERTIFICATE OF CORRECTION

PATENT NO. : 4,867,858

DATED : September 19, 1989

INVENTOR(S) : Hirokage Matsuzawa et al

It is certified that error appears in the above-identified patent and that said Letters Patent is hereby corrected as shown below:

Column 1, Line 41:
After "position" insert -- . -- (2nd occurrence)

Column 2, line 2:
Delete "such a"

Column 3, line 25:
After "Sn" insert -- in the amount of 0.01 to 5%, preferably of 0.5 to 2% by --

Column 4, line 42:
Before "simplification" insert -- (2) --

Column 5, line 10:
After "to" insert -- Table --

Signed and Sealed this

Second Day of July, 1991

*Attest:*

*Attesting Officer*

HARRY F. MANBECK, JR.

*Commissioner of Patents and Trademarks*